US006481173B1

(12) United States Patent
Roy et al.

(10) Patent No.: US 6,481,173 B1
(45) Date of Patent: Nov. 19, 2002

(54) FLAT PANEL SOUND RADIATOR WITH SPECIAL EDGE DETAILS

(75) Inventors: Kenneth P. Roy, Holtwood, PA (US); Richard S. Hendricks, Lancaster, PA (US); Wesley T. K. Bischel, Lancaster, PA (US)

(73) Assignee: AWI Licensing Company, Wilmington, DE (US)

( * ) Notice: Subject to any disclaimer, the term of this patent is extended or adjusted under 35 U.S.C. 154(b) by 0 days.

(21) Appl. No.: 09/641,071

(22) Filed: Aug. 17, 2000

(51) Int. Cl.[7] ..... E04B 9/00

(52) U.S. Cl. ..... 52/506.07; 52/506.06; 52/220.6; 181/171; 181/150

(58) Field of Search ..... 52/506.06, 506.07, 52/220.6, 474; 181/171, 173, 150, 154

(56) References Cited

U.S. PATENT DOCUMENTS 4,027,454 A * 6/1977 Schuplin ..... 52/714
4,139,972 A * 2/1979 Naka ..... 52/208
4,330,691 A 5/1982 Gordon
4,545,161 A * 10/1985 Baumann ..... 52/235
4,923,032 A 5/1990 Nuernberger
4,928,312 A 5/1990 Hill
5,088,574 A 2/1992 Kertesz
5,253,462 A * 10/1993 Blitzer et al. ..... 52/484
5,946,875 A * 9/1999 Jeanseau ..... 52/506.08
6,164,408 A 12/2000 Lamm et al.

* cited by examiner

*Primary Examiner*—Carl D. Friedman
*Assistant Examiner*—Jennifer I. Thissell
(74) *Attorney, Agent, or Firm*—Womble Carlyle Sandridge & Rice, PLLC

(57) ABSTRACT

An apparatus for mounting a flat panel sound radiator into a tegular ceiling. The tegular ceiling has openings defined by main beams and crossbeams. The main beams are secured through hanger wires to a hard ceiling. The main beams and the crossbeams have flanges with the crossbeams resting on the flanges of the main beams. The mounting apparatus has a tegular frame with reveal edges formed by multiple horizontal and vertical plates. A flat panel radiator is mounted inside a tegular frame with the lower edge of the tegular frame below the flanges of the main beams. The radiator panel can be fabricated from a honeycomb core. A combination of containment elements and isolation elements are used to isolate the radiator panel from the tegular frame both mechanically and acoustically. An acoustic scrim is attached to the bottom of the tegular frame.

39 Claims, 10 Drawing Sheets

FLAT PANEL SOUND RADIATOR WITH SPECIAL EDGE DETAILS

CROSS-REFERENCE TO RELATED APPLICATIONS

This patent application is related to, and contains common disclosure with, co-pending and commonly assigned patent applications "Flat Panel Radiator and Assembly System" Ser. No. 09/627,706, and "Flat Panel Radiator with Sound Absorbing Scrim", Ser. No. 09/705,313. The present invention is also related to co-pending and common assigned patent application "Ceiling Panel", Ser. No. 09/141,407 filed Aug. 12, 1998. The co-pending patent applications are hereby incorporated by reference into this description as fully as if here represented in full.

BACKGROUND OF THE INVENTION

This invention relates primarily to electronic sound masking systems in a workplace environment, but may additionally involve any combination of signals including masking, aural enhancement, paging, public address, and background music. More specifically, it relates to sound masking systems adapted for use with a suspended ceiling.

Noise in a workplace is not a new problem, but it is one that is receiving increasing attention as open workplace configurations and business models continue to evolve. A number of recent studies indicate that noise, in the form of conversational distraction, is the single largest negative factor impacting worker productivity.

As the service sector of the economy grows, more and more workers find themselves in offices rather than manufacturing facilities. The need for flexible, reconfigurable space has resulted in open plan workspaces, i.e., large rooms with reduced height, moveable partitions over which sound can pass. The density of workstations is also increasing, with more workers occupying a given physical space. More workers are using speakerphones, conferencing technologies, and multimedia computers with large, sound reflecting screens and even voice input. All these factors tend to increase the noise level in workplaces making the noise problem more difficult and costly for businesses to ignore.

In closed spaces, particularly in office and meeting room settings, speech intelligibility and acoustic performance are determined by a variety of factors, including room shape, furnishings, number of occupants, and especially floor, wall, and ceiling treatments. This acoustic environment will determine how much sound intrusion will occur as well as the level to which the listeners within these spaces will be affected by extraneous noise and conversational distraction.

A more general examination of the interior environment of a room reveals other aspects that play a major role in how sound is perceived by the occupants. Recent research has indicated that when looking at the issue of sound intrusion between spaces, the transmission loss of materials and sound absorption characteristics of materials are not the only contributors to the perceived acoustical environment. Another factor is the background noise in a space. This includes the sounds produced by overhead utilities such as heating, ventilation, and air conditioning (HVAC) ductwork. Another significant factor is the sound, much of which is conversational, that intrudes from adjacent spaces. This has become the focus of much current research. Sound can enter a space in a variety of ways. In an office setting, sound travels through walls or partitions; through open air spaces such as doorways and hallways; and through other air spaces such as HVAC ductwork, registers and diffusers. Sound intrusions may take a number of paths including 1) travel by deflection over partitions that end below the ceiling; 2) through ceiling panels, across the utility/plenum space, and back down through the ceiling; 3) through the structural ceiling deck, the utility/plenum space, and the suspended ceiling, from above; and 4) conversely through the ceiling, utility/plenum space, and ceiling deck/floor from below.

There are two approaches to mitigating the presence of undesired sounds in a space. Sound can be attenuated as it travels from the source, or it can be covered up with some sort of masking technique. It is the latter of these approaches that is the focus of this invention.

Conversational distraction and uncontrolled noise are the primary causes of productivity loss within office workspaces. The principle of sound masking involves the introduction of sound in a specified frequency range. The addition of sound at an appropriate level in the frequency spectrum occupied by the human voice provides a masking effect, in essence, drowning out the undesired sounds in such a way that it is not noticeable to the listener. A typical sound masking system includes the following elements:

1. a "pink noise" signal;
2. a means of filtering the signal to provide the desired spectrum of sound;
3. a means of amplification; and
4. a means of creating a uniform sound field in the area being treated.

A pink noise signal contains equal amounts of sound energy in each one-third octave band, and covers a broad frequency range which includes the speech spectrum. Sound masking is usually accomplished by the introduction of a precisely contoured broadband sound that is constant in level over time, and sufficiently loud to mask conversational distraction and unwanted noise, but not so loud as to be annoying in-of-itself. This sound is similar to that which we attribute to the HVAC system air diffuser. The system generally consists of electronic devices which generate a sound signal, shape or equalize a signal and amplify a signal. This signal is then distributed to an array of speakers that are normally positioned above the ceiling in the plenum on 12–16 foot centers. Sound masking systems in open plan offices are typically set at a sound level which corresponds to 48 dBA (dB "A" weighted)+/−2 dB. This sound level generally insures conversational privacy without causing a distraction itself.

Typical electrodynamic cone loudspeakers have an acoustic radiation pattern that is very dependent upon the frequency of excitation. At low frequencies, these loudspeaker radiate sound fairly uniformly over a broad range of angles. As the frequency of the input wave increases, the sound radiation pattern produced by the loudspeaker becomes more focused and directed on-axis (like a flashlight as opposed to a floodlight). A common 6.5-inch speaker, for example, may have a forward radiation pattern approaching an omni-directional 180 degrees at 250 Hz, but when driven at 4 kHz, the majority of the forward sound energy produced is concentrated in a highly directional beam that is about 15 degrees wide.

Since conventional dynamic loudspeakers produce a directed, coherent sound field at the frequencies of interest in masking, their utilization to create a uniform, diffuse reverberant field presents a challenge.

One solution that has often been employed utilizes traditional dynamic loudspeakers mounted above a ceiling. An array of conventional dynamic loudspeakers is mounted above a suspended ceiling and driven by conventional electrical wiring. The loudspeakers are oriented to fire upwards into the hard floor slab above. This provides a longer reflective path for the sound to travel thus more evenly dispersing the sound in the plenum space. The reflected sound passes through the suspended ceiling system, where it may be further dispersed. The penalty for firing the speakers upwards, however, is that considerable additional power is required to drive the speakers to realize the desired sound levels to the listener. Pointing the loudspeakers directly down through the ceiling, or mounting conventional speakers on top of the ceiling panels, would create a non-uniform sound field at the audible frequencies of interest, with some areas sounding louder and other areas sounding softer. Compensating for this non-uniform sound field would require the use of many more speakers at considerably higher cost. What is needed is a better way to deliver sound to the desired space, and to do so in such a way with a system that is easily installed and simple to configure and change.

SUMMARY OF THE INVENTION

The present invention provides a system for mounting a flat panel sound radiator system in a standard ceiling grid system to generate the desired sound field into an architectural space immediately below. The flat panel radiator includes a stiff radiating panel, a transducer having a magnet attached to the radiating panel, a voice coil assembly attached to the radiating panel, and wiring connected to an excitation source.

Flat panel radiators (speakers) work on the principle that an exciter hooked up to the flat panels causes the panels to vibrate, generating sound. The sound that is generated by flat paneled radiators is not restricted to the cone of sound (beaming) that normal speakers generate. The vibration of the panel generates a complex random ripple of wave forms on the panel surface, which in an ideal model radiates sound in a circular pattern (omni-directional) from the panel. This differs from a standard cone speaker which can be considered as a piston, producing a beam of sound, which, in the field of stereo sound systems results in the phenomenon called the "sweet spot" where the two beams interact most effectively for stereo sound. The omni-directional radiation pattern of the flat panel radiators means that the sound levels are equal across a large listening area.

Flat panel radiators have broad acoustic radiation patterns at the frequencies required for sound masking. As noted, the flat panel radiator includes a light, stiff radiating panel of arbitrary size, and a transducer. The transducer has a magnet clamped to the radiating panel, a voice coil assembly, also attached to the panel, and wiring connected to an excitation source. When electrical current is passed through the voice coil, the resulting combination of electromagnetic field forces with the magnetic field will induce a very small relative displacement, or bending, of the panel material at the mounting points. Rather than the coherent piston-like motion of a cone speaker, the motion of the flat panel is decidedly incoherent, containing many different complex modes spread over the entire surface of the radiator. This effect contributes significantly to the broad radiation pattern and lack of beaming behavior characteristic of this technology. This can best be achieved through a flat panel made of honeycomb cell-type material, which is lightweight and does not rust. This honeycomb material provides minimal loss and a smooth sound pressure response low, middle, and high frequency ranges. The core material is typically "sandwiched" between skins of high strength composite material. A bonding adhesive is used to attach the skin material to the honeycomb core. The resultant honeycomb panel offers one of the highest strength-to weight constructions available.

The present invention includes a flat panel radiator mounted in a suspended ceiling grid. This mounting configuration is compatible with tegular ceiling installation and provides better acoustical performance than a traditional lay-in configuration for a suspended ceiling tile installation. Tegular tiles have an edge profile that is stepped, so that the bottom surface of the tile extends below the plane of the grid support elements. This type of ceiling panel is more commonly referred to as a reveal edge or rabbetted panel. These terms are used interchangeably in this description. The tegular frame elements have "through" openings that expose radiating panels of flat speakers, and are placed into the openings in the supporting grid. The tegular frame overlaps the lower portion of the grid element and is supported by the grid element. The openings expose the radiating panel element of the radiator. A decorative and acoustically transparent scrim attaches to this tegular frame. The flat panel radiator is placed within the tegular frame element and supported by resilient support elements placed inside the tegular frame element.

DESCRIPTION OF THE DRAWINGS

The invention is better understood by reading the following detailed description of the invention in conjunction with the accompanying drawings, wherein.

DETAILED DESCRIPTION OF THE INVENTION

Figure 1:
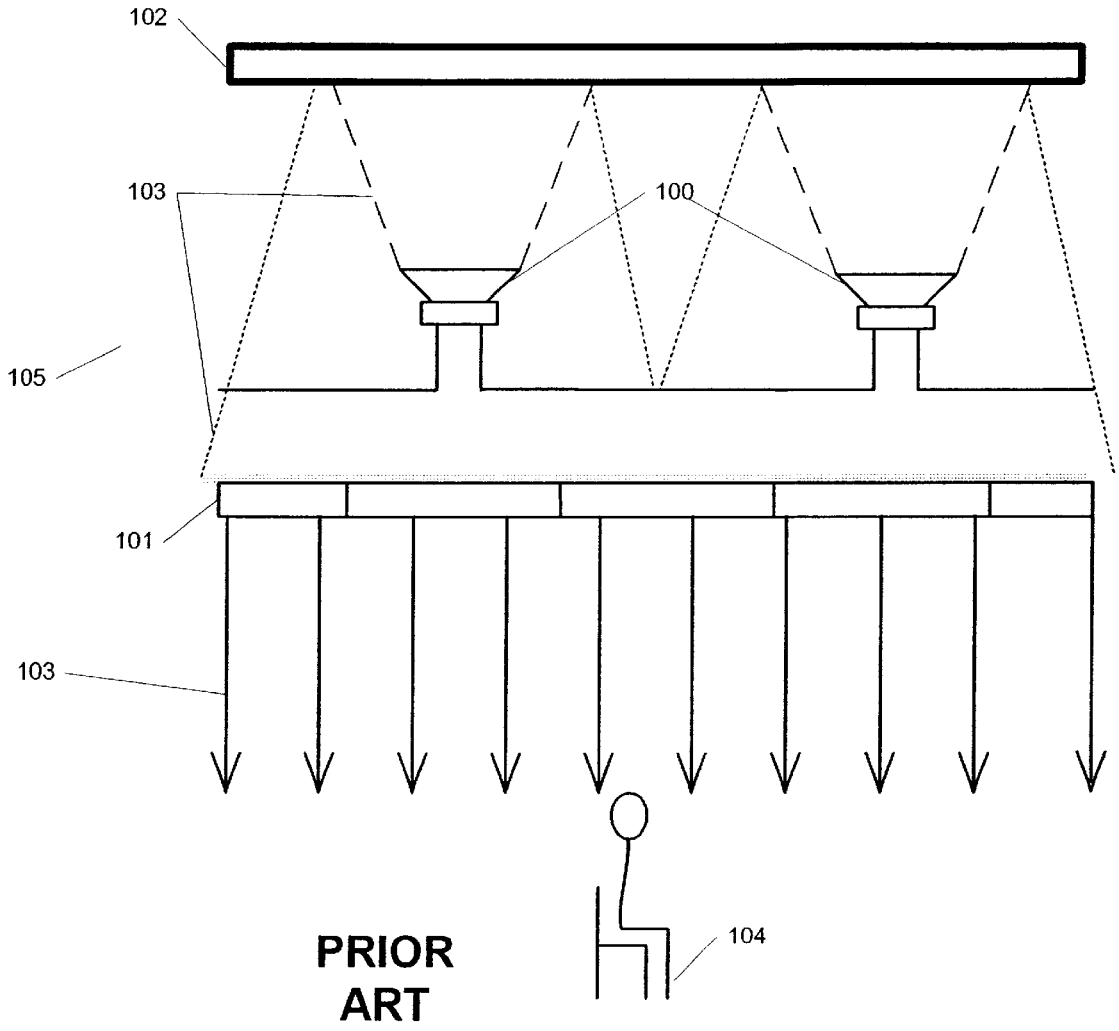
FIG. 1 illustrates a prior art sound system arranged to create a uniform, diffused, reverberant sound field.

Referring now in more detail to the drawings in which like numerals refer to like parts throughout the several views, FIG. 1 illustrates a prior art sound system arranged to produce a modified pink noise signal to mask undesirable noises. This signal is often referred to as "white noise" although it is technically not, but it is characterized as a broadband uniform field of masking sound. The speaker arrangement in the prior art utilizes traditional dynamic loudspeakers mounted above a ceiling, on 12–16 foot centers, as shown in the diagram of FIG. 1. An array of conventional dynamic loudspeakers 100 is mounted above a suspended ceiling 101, powered through conventional electrical wiring 105. The loudspeakers are oriented to fire upwards into the hard slab above 102. This arrangement provides a longer path for the sound to travel, and further disperses the sound field 103, depending upon the surface treatment of the hard slab above. The reflected sound passes through the suspended ceiling system 101, where it may be further dispersed, so that the sound field 103 at the listener 104 is relatively diffused and uniform, as indicated by the arrows. Pointing the loudspeakers directly down through the ceiling, or mounting conventional speakers on top of the ceiling panels, would create a non-uniform sound field at the frequencies of interest, with some areas sounding louder and some sounding softer. Compensating for the non-uniform sound field requires the use of many more speakers at considerably higher cost. The penalty for firing the speakers upwards, however, is that considerable additional power is required to drive the speakers 100 to realize the desired sound levels to the listener 104.

Figure 2:
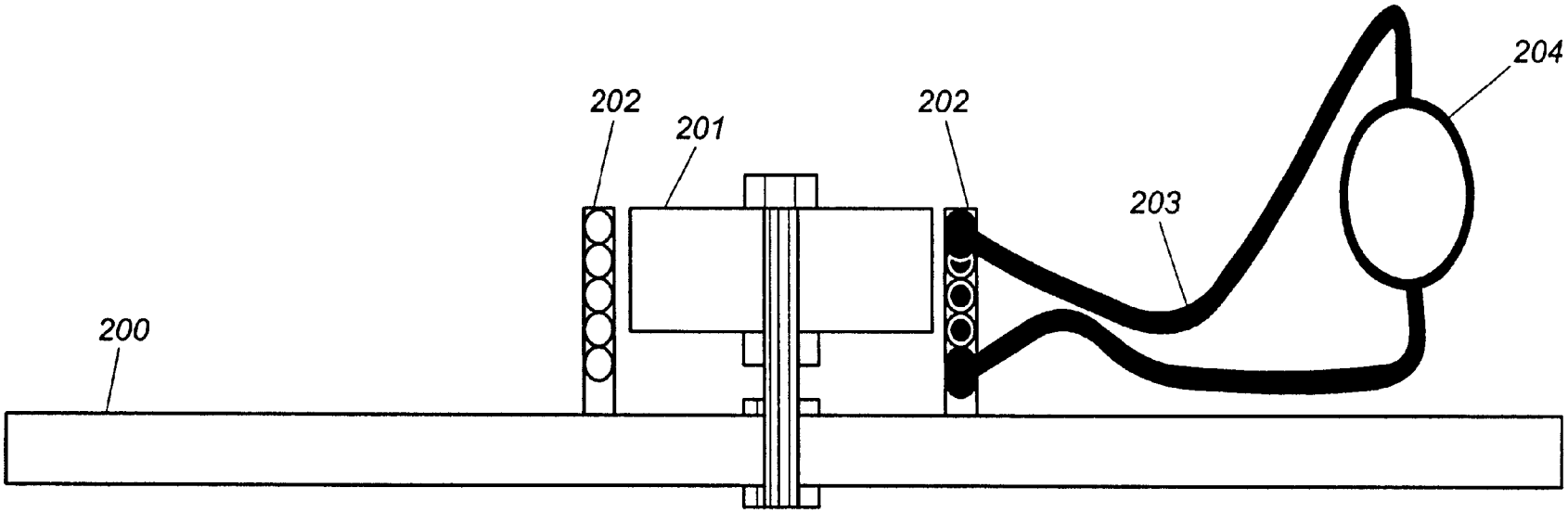
FIG. 2 illustrates a cross-section of a flat panel radiator that can be utilized in the present invention.

An alternative approach to generating acoustic frequencies for sound masking has been the development of flat panel radiator technology. Historical attempts to make high quality flat panel radiators have focused on duplicating the behavior of cone speakers. These efforts have not met with much success until fairly recently. Flat panel radiators are now available that have broad acoustic radiation patterns at the frequencies required for sound masking in an open workplace environment. The flat panel radiator, shown in FIG. 2, includes a light, stiff radiating panel 200 of arbitrary size, and a transducer. The transducer contains a magnet 201 that is clamped to the radiating panel 200, a voice coil assembly 202, also attached to the radiating panel 200, and electrical wiring 203 connected to an excitation source 204 that is not part of the radiator system. There are at least two embodiments of the transducer that can be used in flat panel products. FIG. 2 shows the "bender" or "clamped" driver. When electrical current is passed through the voice coil 202, the electromagnetic field generated by the coil and the magnetic field from the magnet 201 interact, thus inducing a very small relative displacement, or bending, of the panel material 200 between the voice coil 202 and magnet 201 mounting points. Rather than the coherent piston-like motion of a cone speaker, the motion of the flat panel 200 is decidedly incoherent, containing many different complex modes spread over the entire surface of the radiator 200. This effect contributes significantly to the broad radiation pattern and lack of beaming behavior characteristic of this technology.

Figure 3:
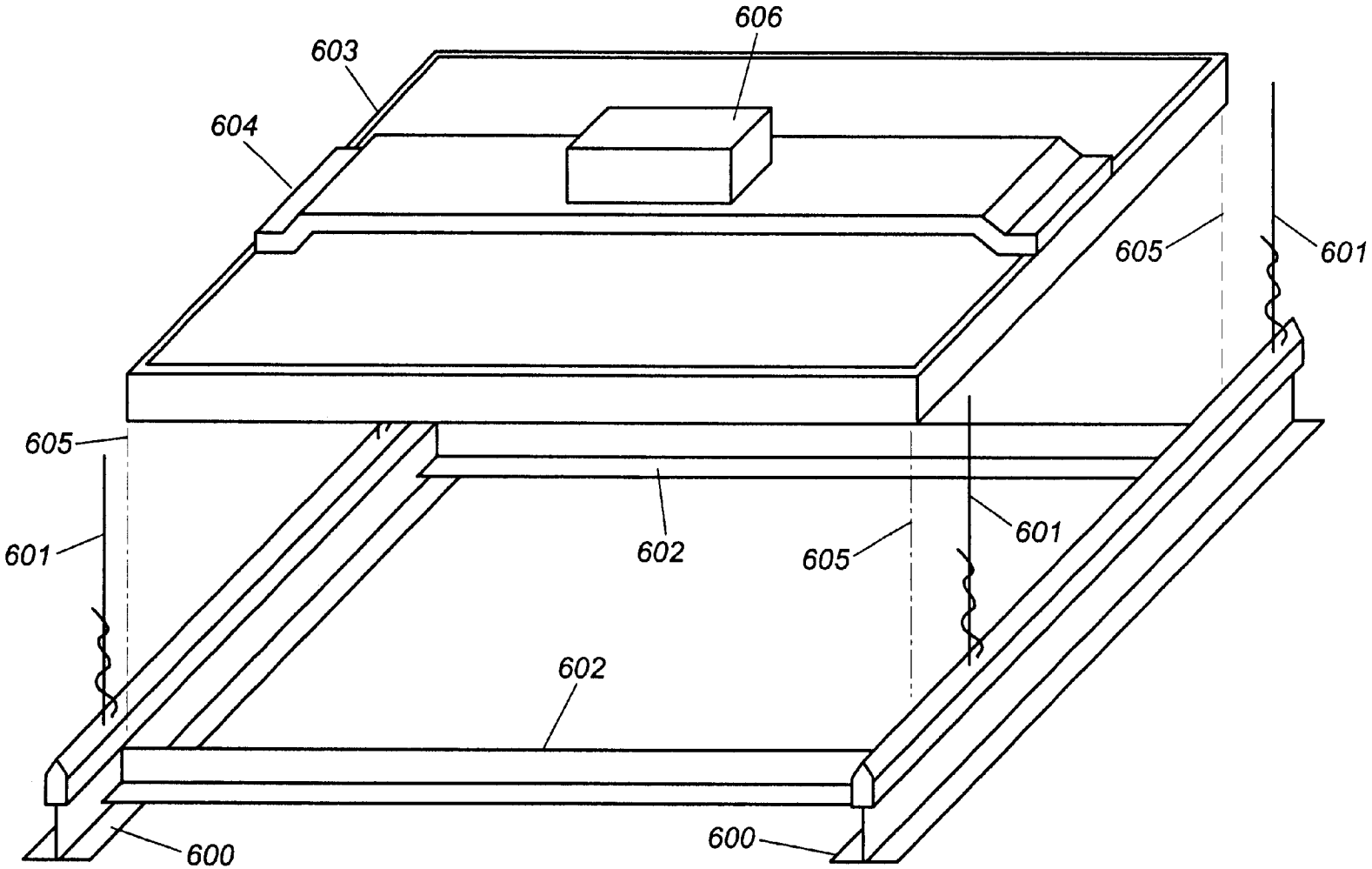
FIG. 3 illustrates the mounting of a flat panel radiator in a standard inverted "T" ceiling grid.

In the current art, a flat panel radiator is mounted in a frame to allow its installation in a standard inverted "T" ceiling grid. FIG. 3 shows a section of a ceiling grid, including inverted tee main beams 600, supporting hanger wires 601, and cross tee beams 602. The radiator panel frame element 603 with an attached bridge support element 604 and an enclosure 606 is placed into the grid elements as shown by the dotted lines 605. The enclosure 606 contains a terminal block (not shown) for connecting the transducer to an external-driving source.

Figure 4:
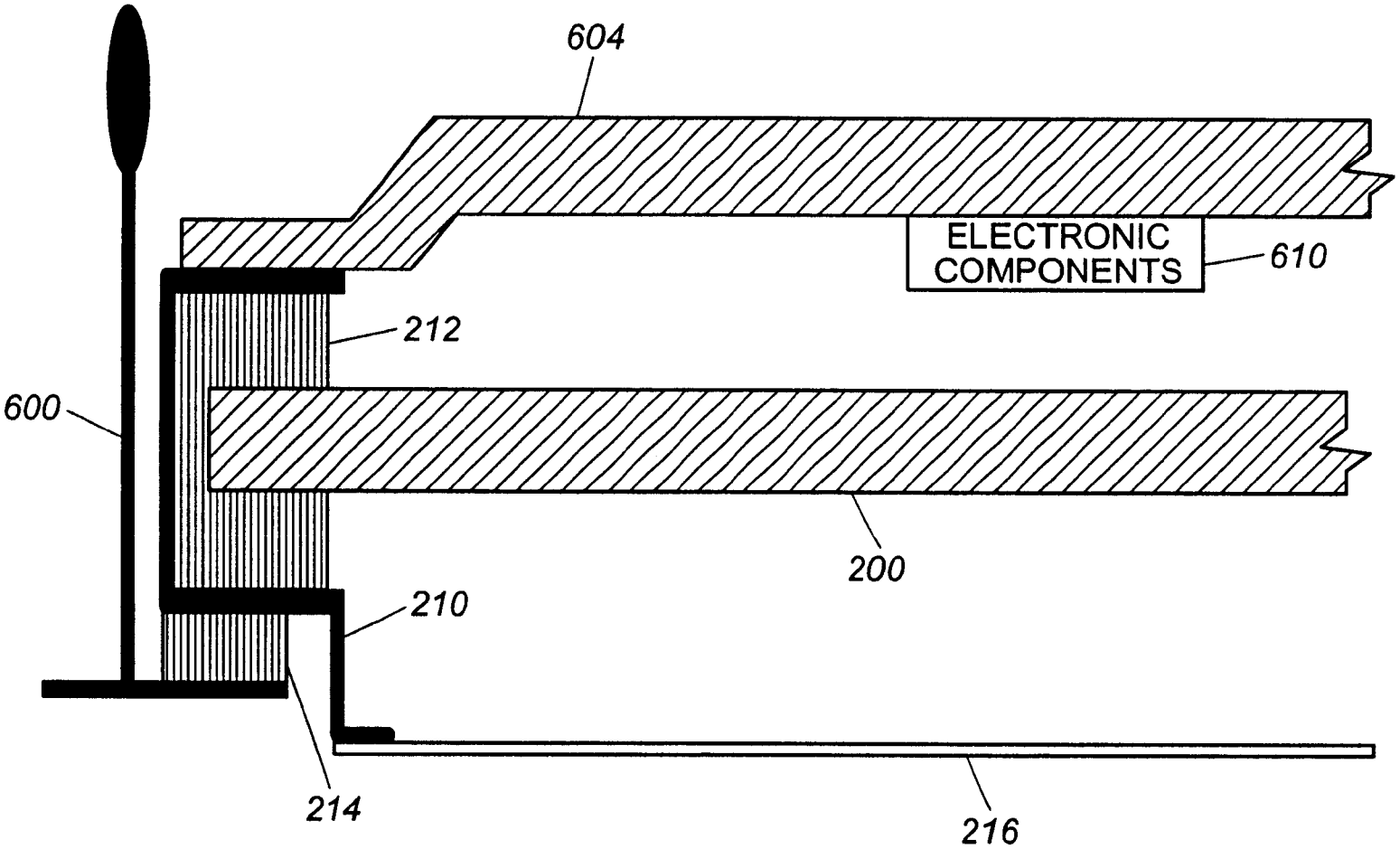
FIG. 4 illustrates an embodiment of a tegular "C"-shaped frame with a containment element for a flat panel radiator.

FIG. 4 depicts a cross-sectional view of an embodiment of a tegular C-shaped frame for mounting a flat panel radiator. The flat panel radiator 200 is supported by a C-shaped containment element 212. The C-shaped containment element 212 is placed inside the tegular C-shaped frame element 210. The tegular C-shaped frame element includes a lower plate, a first side plate, an upper plate, a second side plate, and a top plate. The lower plate and first side plate extend below the bottom of the ceiling grid 600. An isolation element 214 isolates the frame structure from the ceiling grid both acoustically and mechanically. A bridge support element 604 is placed above and across the frame 210. Attached to the underside of the bridge support element 604 is a box containing electronic elements 610. A decorative facing 216 is attached to the lower surface of the lower plate.

Figure 5:
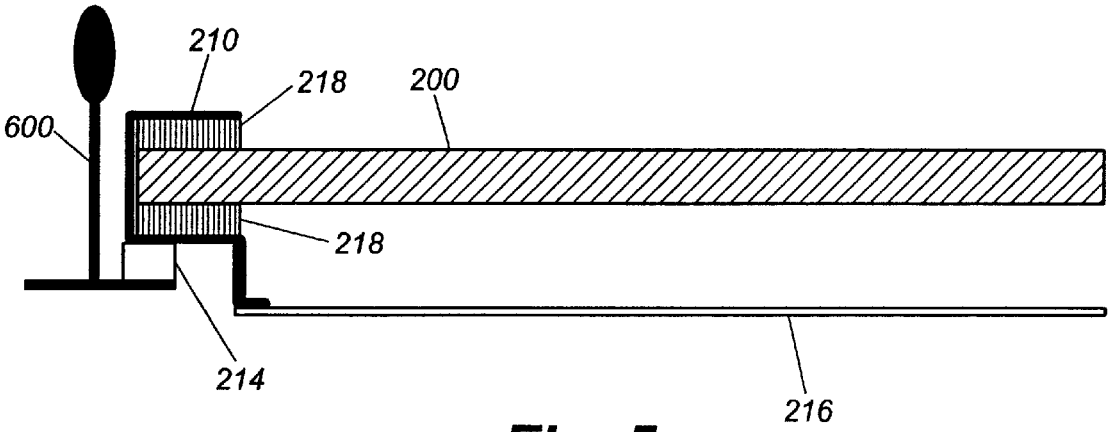
FIG. 5 illustrates an alternate embodiment of a tegular "C"-shaped frame with containment elements for a flat panel radiator.

FIG. 5 illustrates an alternate embodiment of the tegular C-shaped frame of FIG. 4 in which the containment element is not C-shaped. In this embodiment, containment elements 218 are positioned at the top and at the bottom of the flat panel radiator 200. The containment elements 218 do not need to be continuous along any edge of the flat panel radiator 200. Furthermore, the containment elements 218 may be used on two edges instead of four. Isolation element 214 isolates the flat panel radiator from the ceiling grid 600.

Figure 6:
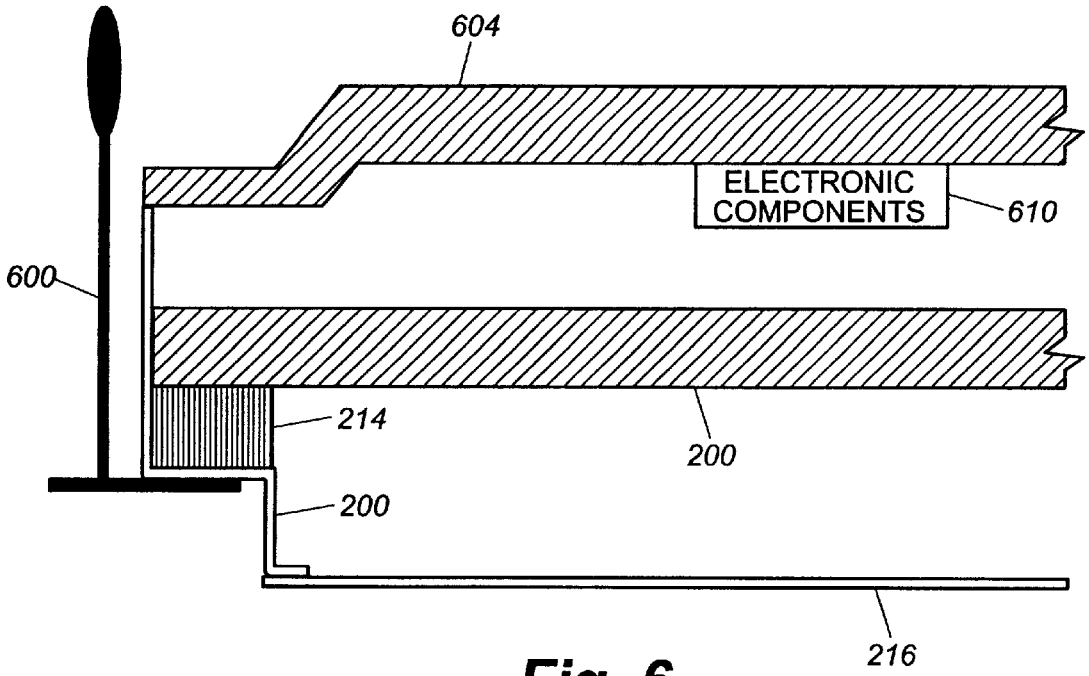
FIG. 6 illustrates an embodiment of a tegular "L"-shaped frame with an isolation element for a flat panel radiator.

FIG. 6 illustrates an embodiment of a tegular L-shaped frame with an isolation element. In this embodiment, the edge of the flat panel radiator 200 cannot be clamped, and the isolation element 214 functions both to hold the flat panel radiator in place with adhesive and to provide isolation. As illustrated in the figure, the tegular L-shaped frame 220 is positioned on the ceiling grid structure and has a side and a bottom plate that extend below the ceiling grid flanges. A low resistance acoustic scrim (facing) 216 is attached to the bottom plate of the tegular L-shaped frame 220.

Figure 7A:
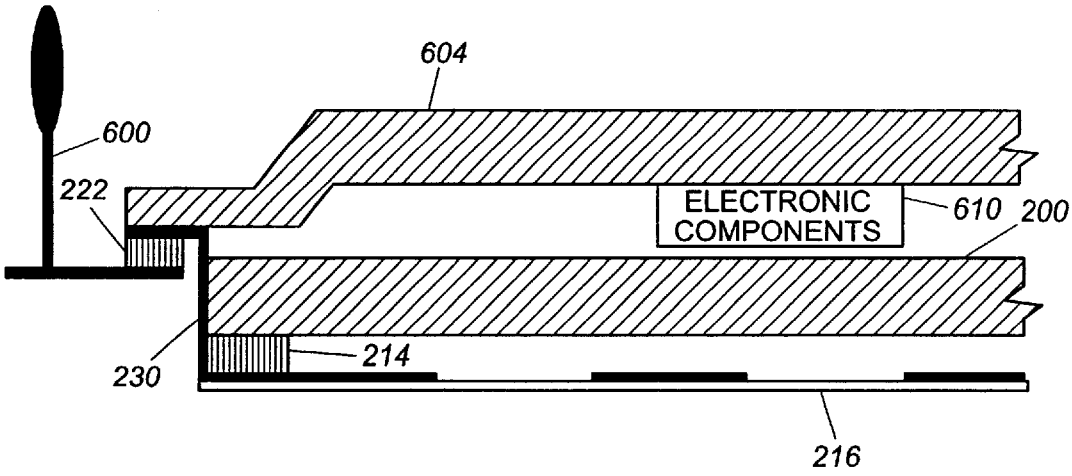
FIGS. 7A–7B illustrate an embodiment of a tegular "Z"-shaped and a tegular "CZ"-shaped frame with a containment element and an isolation element for a flat panel radiator.
Figure 7B:
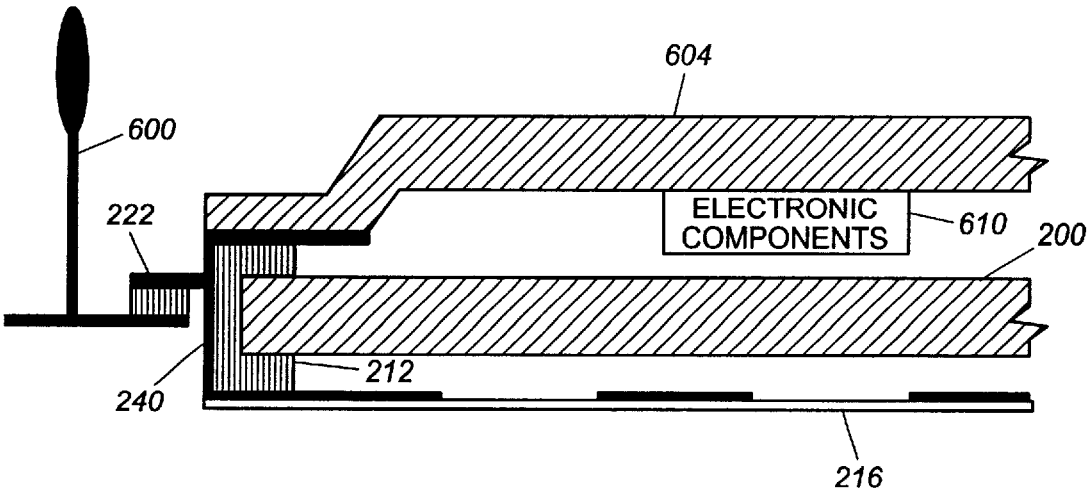

FIGS. 7A–7B depict a tegular "Z"-shaped frame. As shown in FIG. 7A, the flat panel radiator 200 is placed within the tegular Z-shaped frame 230 and is supported by containment element 214 which is attached by adhesive to the lower surface of the flat panel radiator. An isolation element 222 is provided between the lower surface of the top plate of Z-shaped frame 230 and the flanges of the ceiling grid 600. A low resistance acoustic facing 216 is attached to the lower surface of the Z-shaped frame 230. FIG. 7B is a variation of the tegular Z-shaped frame of FIG. 7A. The embodiment shown in FIG. 7B is a tegular "CZ"-shaped frame. A C-shaped containment element 212 is used to support the flat panel radiator 200 within the CZ-shaped frame 240. Isolation element 222 isolates the CZ-shaped frame from the ceiling grid 600.

Figure 8:
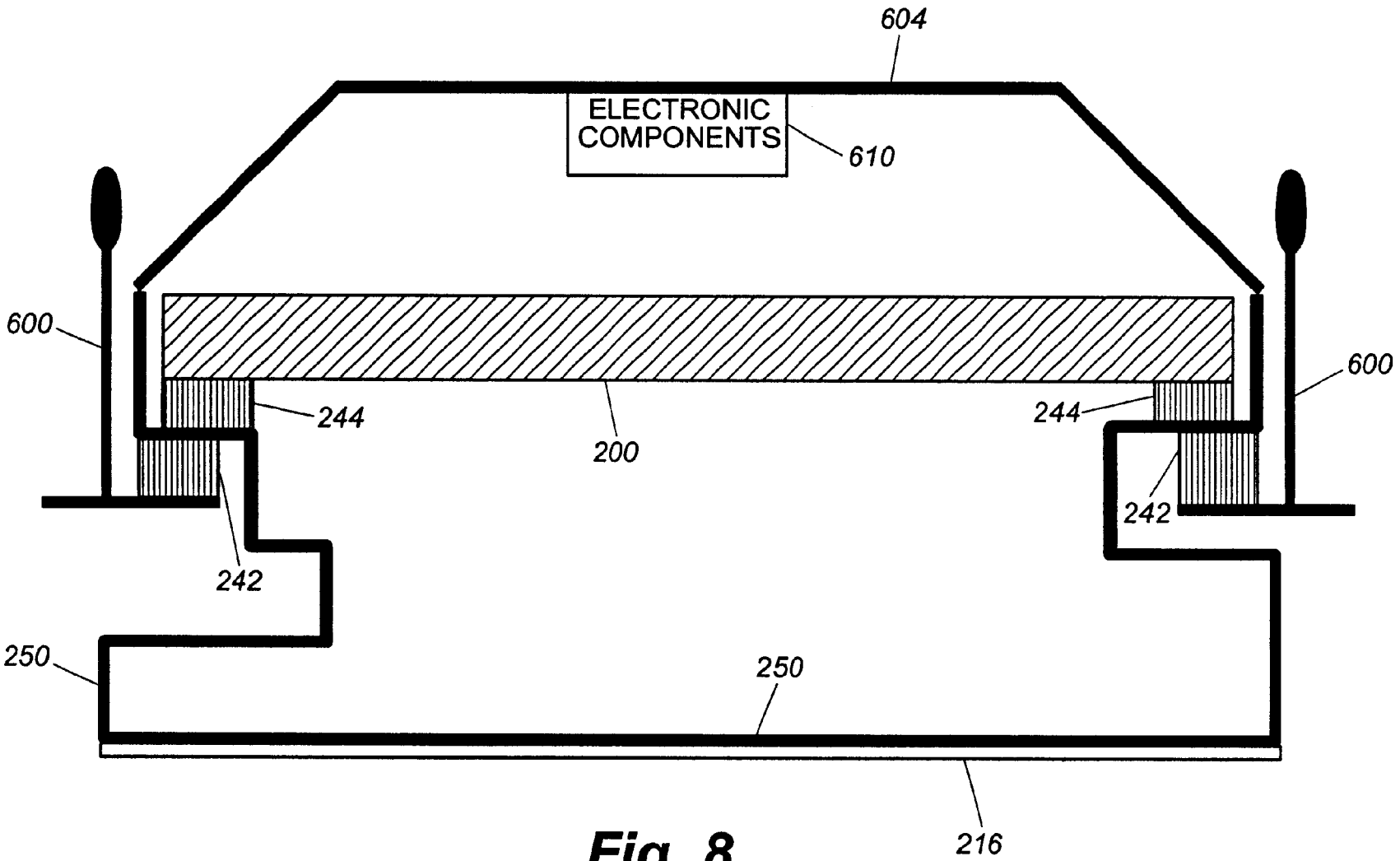
FIG. 8 illustrates an embodiment of a vector-shaped frame with isolation elements for a flat panel radiator.

FIG. 8 illustrates an embodiment of a tegular vector-shaped frame with isolation elements. Isolation elements 242 isolate the vector frame 250 both mechanically and acoustically from the ceiling grid 600. Isolation elements 244 isolate the flat panel radiator 200 from the vector frame 250 and grid 600. In other embodiments using the vector frame 250, either of the isolation element pairs 242 or 244 can be eliminated. Also shown in FIG. 8 is bridge element 604 to which is affixed electronics component box 610. The bridge element 604 is positioned on the top edges of vector frame 250.

Figure 9:
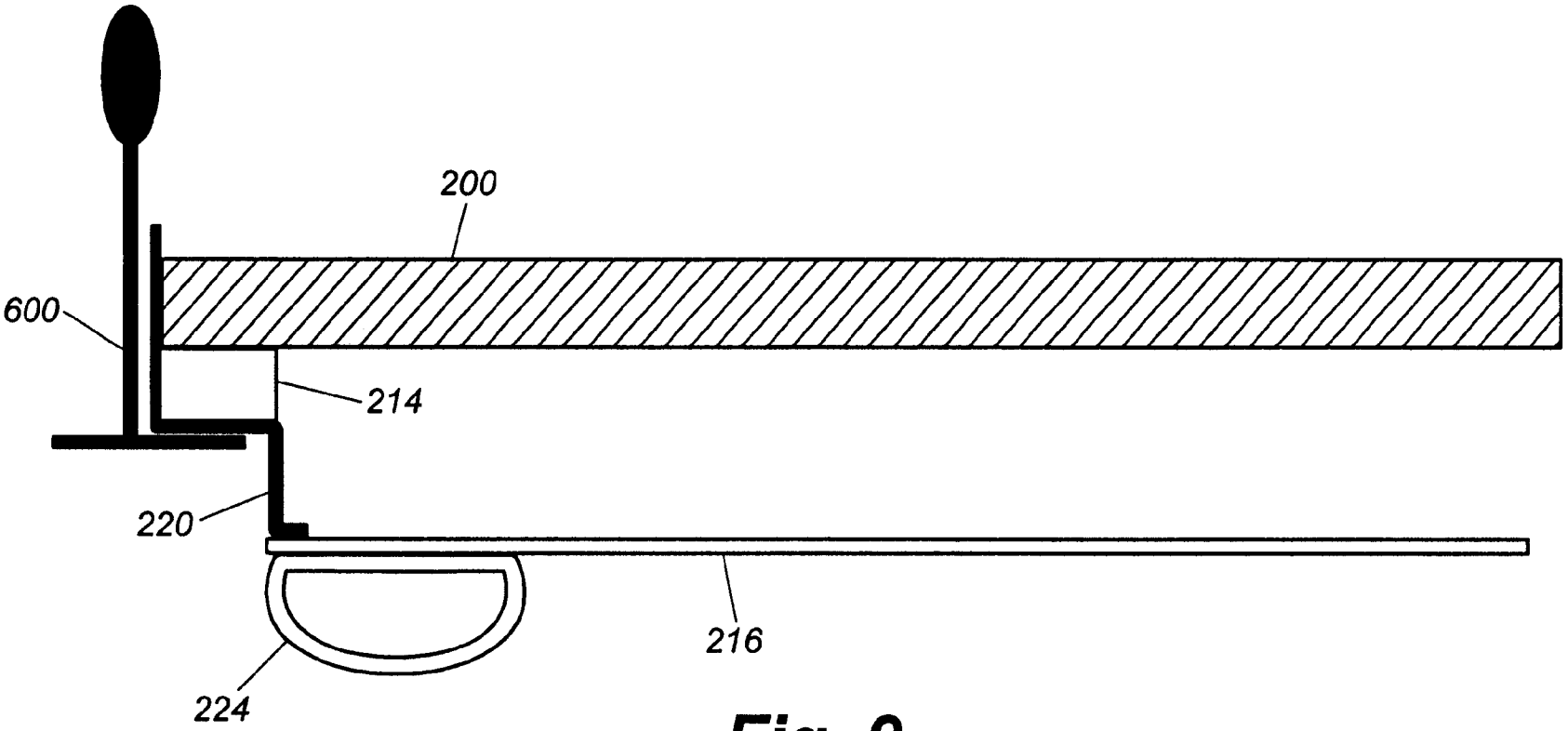
FIG. 9 illustrates the addition of a decorative element to a tegular Z-shaped frame for aesthetic purposes.

FIG. 9 illustrates the attachment of a decorative element 224 to a tegular Z-shaped frame. The decorative element 224 is attached to one surface of the facing element 216. The other side of the facing element 216 is attached to the lower surface of the tegular Zshaped frame.

Figure 10:
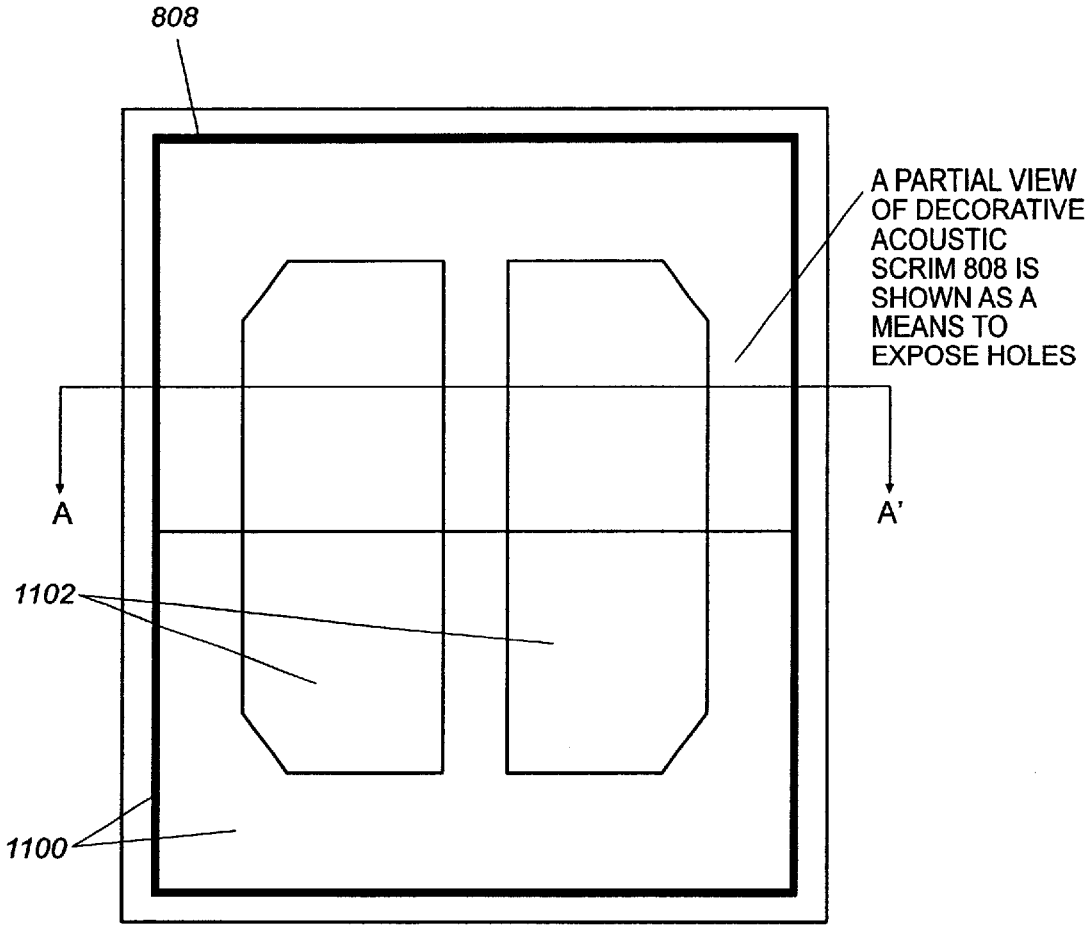
FIG. 10 illustrates a partial view of an acoustic scrim for use with tegular suspended ceilings.

FIG. 10 is a partial view of an acoustic scrim for use with tegular suspended ceilings. The tegular frame element 1100 is generally a rectangular frame that is slightly larger than openings of grid elements and has a raised face that is slightly smaller than the same openings. It is understood that the tegular frame elements 1100 can have different shapes and sizes, and that the openings of grid elements can have similarly different matching shapes and sizes. The tegular frame elements 1100 are placed into the openings of the grid elements, as shown in FIG. 10, and are supported by overlapping the lower portion (flange) of the grid element. In this embodiment, the tegular frame element 1100 has two openings 1102 that expose tegular tiles or panels of a flat panel radiator to the space below the suspended ceiling system. In other embodiments the tegular frame element 1100 can have a different number of openings 1102 and different shapes of openings 1102. A scrim 808 is attached to the tegular frame element 1100 and spans the openings 1102 defined by the tegular frame element 1100.

Figure 11:
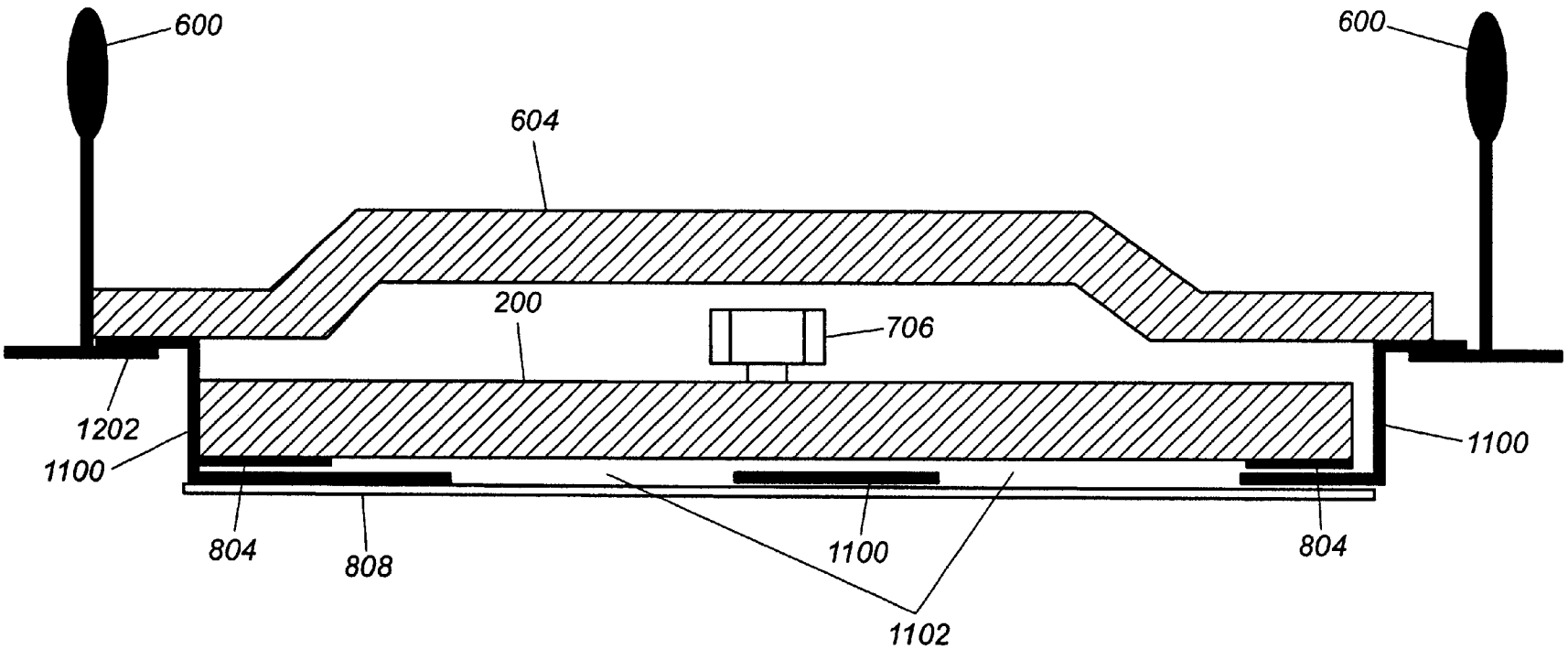
FIG. 11 illustrates a cross-sectional view of another embodiment of the tegular isolation mounting of the present invention for tegular panels with openings in the frame element for passage of acoustical energy.

FIG. 11 illustrates a radiating panel 200 supported by a tegular Z-shaped frame. A transducer assembly 706 is attached to the upper surface of the flat panel radiator 200. The mounting bridge support 604 adds dimensional stability to the Z-shaped frame 1100 and supports a box (not shown) containing electronic elements. The radiating panel 200 is centered within the tegular Z-shaped frame element 1100 and supported by isolation elements 804 that are generally resilient. The isolation element 804 is attached along the top surface of the tegular frame element 1100. The openings 1102 in the tegular frame elements 1100 provide a transmissive passage for acoustical energy to permeate through the tegular frame 1100 and the decorative acoustic scrim 808. The resilient isolation element 804 provides mechanical support to the radiating panel 200 around its perimeter and prevents it from coming into contact with the frame element 1100. It is understood that tegular frame 1100 can be constructed of any number of suitable materials such as metal, plastic, or nylon.

Although the present invention has been described in the context of supporting flat panel sound radiators wherein the frame has special edge details, it is applicable to mounting a wide variety of other devices in a ceiling grid. For example, the apparatus described can be used to support traditional loudspeakers, lighting fixtures or air diffusers among other devices. Such devices can be directly supported by a bridge support element that is affixed to the apparatus frame. The person of ordinary skill in the art will recognize many additional uses that can be made of the present invention with, or without modifications to the disclosed structures.

The corresponding structures, materials, acts, and equivalents of any means plus function elements in any claims below are intended to include any structure, material, or acts for performing the functions in combination with other claimed elements as specifically claimed.

While the invention has been particularly shown and described with reference to preferred embodiments thereof, it will be understood by those skilled in the art that various changes in form and detail may be made without departing from the spirit and scope of the present invention.

What is claimed is:

1. A flat panel radiator apparatus for use in a ceiling grid that includes a plurality of main beams and crossbeams with the crossbeams supported by the main beams to define an opening for mounting a flat panel radiator, the apparatus comprising:

a frame including an upper plate, a first side plate and a lower plate, wherein the first side plate is rigidly fixed between a first edge of the lower plate and the upper plate, wherein the upper plate is rigidly fixed to the upper portion of the first side plate to form a cross-section having a generally Z-shaped portion;

an isolation element capable of being interposed between the flat panel radiator and the ceiling grid to isolate the flat panel radiator from the beams of the ceiling grid; and a substantially acoustically transparent facing disposed below the flat panel radiator and capable of extending across the opening defined by the plurality of main beams and crossbeams.

2. The flat panel radiator apparatus of claim 1 wherein the upper plate is rigidly fixed to the edge of the first side plate opposite the lower plate and the frame further comprises a second side plate rigidly fixed to the upper plate opposite the first side plate and extending away from the first side plate, and forming a generally L-shaped portion.

3. The flat panel radiator apparatus of claim 1 further comprising a bridge supporting element attached to the frame and providing a mounting surface for electronic components.

4.The flat panel radiator apparatus of claim 1 wherein the facing is secured to the lower surface of the lower plate and capable of extending across the opening defined by the plurality of main beams and crossbeams.

5. The flat panel radiator apparatus of claim 1 wherein the facing is secured to the upper surface of the lower plate and capable of extending across the opening defined by the plurality of main beams and crossbeams.

6. The flat panel radiator apparatus of claim 1 wherein the isolation element comprises a resilient material.

7. The flat panel radiator apparatus of claim 1 wherein the isolation element is capable of isolating the flat panel radiator both mechanically and acoustically from the ceiling grid.

8. The flat panel radiator apparatus of claim 1 wherein the isolation element is affixed by an adhesive material to the frame.

9. The flat panel radiator apparatus of claim 1 wherein the frame has a cross-section described generally as a vector edge profile.

10. The flat panel radiator of claim 1 wherein a decorative element is affixed to the lower surface of the lower plate.

11. The flat panel radiator of claim 1 wherein the lower plate has multiple openings for the passage of acoustical energy.

12. A flat panel radiator apparatus for use in a ceiling grid that includes a plurality of main beams and crossbeams with the crossbeams supported by the main beams to define an opening for mounting a flat panel radiator, the apparatus comprising:

a frame including an upper plate, a first side plate and a lower plate, wherein the first side plate is rigidly fixed between a first edge of the lower plate and the upper plate, wherein the upper plate is rigidly fixed to the upper portion of the first side plate to form a cross-section having a generally Z-shaped portion;

an isolation element capable of being interposed between the flat panel radiator and the ceiling grid to isolate the flat panel radiator from the beams of the ceiling grid;

a substantially acoustically transparent facing disposed below the flat panel radiator and capable of extending across the opening defined by the plurality of main beams and crossbeams; and wherein the upper plate is rigidly fixed to the edge of the first side plate opposite the lower plate and the frame further comprises a second side plate rigidly fixed to the upper plate opposite the first side plate and extending away from the first side plate, and a top plate rigidly fixed to the edge of the second side plate, and forming a cross-section having a generally C-shaped portion.

13. The flat panel apparatus of claim 12 further comprising a pair of containment elements affixed to the inner surfaces of the upper plate and top plate to support the flat panel radiator within the C-shaped portion of the frame.

14. The flat panel radiator apparatus of claim 12 further comprising a containment element affixed to the inner surfaces of the upper plate and top plate to support the flat panel radiator within the C-shaped portion of the frame.

15. A flat panel radiator apparatus for use in a ceiling grid that includes a plurality of main beams and crossbeams with the crossbeams supported by the main beams to define an opening for mounting a flat panel radiator, the apparatus comprising:

a frame including an upper plate, a first side plate and a lower plate, wherein the first side plate is rigidly fixed between a first edge of the lower plate and the upper plate, wherein the upper plate is rigidly fixed to the upper portion of the first side plate to form a cross-section having a generally Z-shaped portion;

an isolation element capable of being interposed between the flat panel radiator and the ceiling grid to isolate the flat panel radiator from the beams of the ceiling grid;

a substantially acoustically transparent facing disposed below the flat panel radiator and capable of extending across the opening defined by the plurality of main beams and crossbeams; and wherein the upper plate is rigidly fixed to the side of the first side plate opposite the lower plate and adjacent the edge of the first side plate opposite the lower plate, and the frame further comprises a top plate rigidly fixed to the edge of the first side plate opposite the upper plate, and forming a cross-section having a generally C-shaped portion with a horizontal member extending outwardly from the vertical member of the C.

16. The flat panel radiator apparatus of claim 15 further comprising a pair of containment elements affixed to the inner surfaces of the lower plate and top plate to support the flat panel radiator within the C-shaped portion of the frame.

17. The flat panel radiator apparatus of claim 15 further comprising a containment element affixed to the inner surfaces of the lower plate and the top plate to support the flat panel radiator within the C-shaped portion of the frame.

18. The flat panel radiator apparatus of any one of claims 1, 2, 12, or 15 wherein the isolation element is affixed to the frame at a location selected from the group consisting of the upper surface of the upper plate, the lower surface of the upper plate, and the upper surface of the lower plate.

19. The flat panel radiator apparatus of any one of claims 13, 14, 16, or 17 wherein each containment element comprises a resilient material.

20. A flat panel radiator apparatus for use in a ceiling grid that includes a plurality of main beams and crossbeams with the crossbeams supported by the main beams to define an opening for mounting a flat panel radiator, the apparatus comprising:

a frame including an upper plate, a first side plate and a lower plate, wherein the first side plate is rigidly fixed between a first edge of the lower plate and the upper plate, wherein the upper plate is rigidly fixed to the upper portion of the first side plate to form a cross-section having a generally Z-shaped portion;

an isolation element capable of being interposed between the flat panel radiator and the ceiling grid to isolate the flat panel radiator from the beams of the ceiling grid;

a substantially acoustically transparent facing disposed below the flat panel radiator and capable of extending across the opening defined by the plurality of main beams and crossbeams;

a bridge supporting element attached to the frame and providing a mounting surface for electronic components; and electrical components disposed inside a terminal box mounted on the bridge supporting element.

21. The flat panel radiator apparatus of claim 20 wherein the terminal box is mounted on the lower surface of the bridge supporting element.

22. A flat panel radiator apparatus for use in a ceiling grid that includes a plurality of main beams and crossbeams with the crossbeams supported by the main beams to define an opening for mounting a flat panel radiator, the apparatus comprising:

a frame including an upper plate, a first side plate and a lower plate, wherein the first side plate is rigidly fixed between a first edge of the lower plate and the upper plate, wherein the upper plate is rigidly fixed to the upper portion of the first side plate to form a cross-section having a cross section described generally as a vector edge profile;

an isolation element capable of being interposed between the flat panel radiator and the ceiling grid to isolate the flat panel radiator from the beams of the ceiling grid;

a substantially acoustically transparent facing disposed below the flat panel radiator and capable of extending across the opening defined by the plurality of main beams and crossbeams;

a first isolation element affixed to the upper surface of the upper plate of the frame; and a second isolation element affixed to the lower surface of the upper plate of the frame.

23. An apparatus for mounting a device in a ceiling grid that includes a plurality of main beams and crossbeams with the crossbeams supported by the main beams to define an opening for mounting the device, the apparatus comprising:

a frame having an upper plate, a side plate and a lower plate, wherein the side plate is rigidly fixed between a first edge of both the upper plate and lower plate to form a cross-section having a generally Z-shaped portion;

a bridge support element affixed to the frame for supporting the device;

a substantially transparent facing disposed below the device and capable of extending across the opening defined by the plurality of main beams and crossbeams.

24. The apparatus for mounting a device of claim 23 wherein the device is capable of being attached to the bridge support element is selected from any one of a loudspeaker, a lighting fixture, and an air diffuser.

25. The apparatus of claim 23 wherein the facing is secured to the lower surface of the lower plate and is capable of extending across the openings defined by the plurality of main beams and crossbeams.

26. The apparatus of claim 23 wherein the facing is secured to the upper surface of the lower plate and is capable of extending across the openings defined by the plurality of main beams and crossbeams.

27. A flat panel radiator apparatus for use in a ceiling grid that includes a plurality of main beams and crossbeams with the crossbeams supported by the main beams to define an opening for mounting a flat panel radiator, the apparatus comprising:

a frame including an upper plate, a first side plate and a lower plate, wherein the first side plate is rigidly fixed between a first edge of the lower plate and the upper plate, wherein the upper plate is rigidly fixed to the upper portion of the first side plate to form a cross-section having a generally Z-shaped portion; and an isolation element capable of being interposed between the flat panel radiator and the ceiling grid to isolate the flat panel radiator from the beams of the ceiling grid.

28. The flat panel radiator apparatus of claim 27 wherein the upper plate is rigidly fixed to the edge of the first side plate opposite the lower plate and the frame further comprises a second side plate rigidly fixed to the upper plate opposite the first side plate and extending away from the first side plate, and forming a generally L-shaped portion.

29. The flat panel radiator apparatus of claim 27 further comprising a substantially acoustically transparent facing disposed below the flat panel radiator and capable of extending across the opening defined by the plurality of main beams and crossbeams.

30. The flat panel radiator apparatus of claim 27, wherein the isolation element is capable of isolating the flat panel radiator both mechanically and acoustically from the ceiling grid.

31. The flat panel radiator apparatus of claim 27 wherein the frame has a cross-section described generally as a vector edge profile.

32. The flat panel radiator apparatus of claim 27 wherein the first isolation element affixed to the upper surface of the upper plate of the frame and a second isolation element is affixed to the lower surface of the upper plate of the frame.

33. A flat panel radiator apparatus for use in a ceiling grid that includes a plurality of main beams and crossbeams with the crossbeams supported by the main beams to define an opening for mounting a flat panel radiator, the apparatus comprising:

a frame including an upper plate, a first side plate and a lower plate, wherein the first side plate is rigidly fixed between a first edge of the lower plate and the upper plate, wherein the upper plate is rigidly fixed to the upper portion of the first side plate to form a cross-section having a generally Z-shaped portion; and an isolation element capable of being interposed between the flat panel radiator and the ceiling grid to isolate the flat panel radiator from the beams of the ceiling grid; and wherein the upper plate is rigidly fixed to the edge of the first side plate opposite the lower plate and the frame further comprises a second side plate rigidly fixed to the upper plate opposite the first side plate and extending away from the first side plate, and a top plate rigidly fixed to the edge of the second side plate, and forming a cross-section having a generally C-shaped portion.

34. The flat panel radiator apparatus of claim 33 further comprising a pair of containment elements affixed to the inner surfaces of the upper plate and top plate to support the flat panel radiator within the C-shaped portion of the frame.

35. The flat panel radiator apparatus of claim 33 further comprising a containment element affixed to the inner surfaces of the upper plate and top plate to support the flat panel radiator within the C-shaped portion of the frame.

36. A flat panel radiator apparatus for use in a ceiling grid that includes a plurality of main beams and crossbeams with the crossbeams supported by the main beams to define an opening for mounting a flat panel radiator, the apparatus comprising:

a frame including an upper plate, a first side plate and a lower plate, wherein the first side plate is rigidly fixed between a first edge of the lower plate and the upper plate, wherein the upper plate is rigidly fixed to the upper portion of the first side plate to form a cross-section having a generally Z-shaped portion; and an isolation element capable of being interposed between the flat panel radiator and the ceiling grid to isolate the flat panel radiator from the beams of the ceiling grid; and wherein the upper plate is rigidly fixed to the side of the first side plate opposite the lower plate and adjacent the edge of the first side plate opposite the lower plate, and the frame further comprises a top plate rigidly fixed to the edge of the first side plate opposite the upper plate, and forming a cross-section having a generally C-shaped portion with a horizontal member extending outwardly from the vertical member of the C.

37. The flat panel radiator apparatus of claim 36 further comprising a pair of containment elements affixed to the inner surfaces of the lower plate and top plate to support the flat panel radiator within the C-shaped portion of the frame.

38. The flat panel radiator apparatus of claim 36 further comprising a containment element affixed to the inner surfaces of the lower plate and top plate to support the flat panel radiator with the C-shaped portion of the frame.

39. The flat panel apparatus of any one of claims 27, 28, 33 or 36 wherein the isolation element is affixed to the frame at a location selected from the group consisting of the upper surface of the upper plate, the lower surface of the upper plate, and the upper surface of the lower plate.

* * * * *